United States Patent [19]

Kappenhagen et al.

[11] 4,356,895

[45] Nov. 2, 1982

[54] ELEVATOR SYSTEM

[75] Inventors: George A. Kappenhagen, Stroud Township, Monroe County; Niles J. Martin, Bonneauville; John E. Pace, York; Robert A. Sette, Gettysburg; Charles E. Randall, Boiling Springs; Leigh F. Jackson, Guilford Township, Franklin County; Gurdip S. Bains, Bonneauville, all of Pa.

[73] Assignee: Westinghouse Electric Corp., Pittsburgh, Pa.

[21] Appl. No.: 219,103

[22] Filed: Dec. 22, 1980

[51] Int. Cl.[3] ..... B66B 11/04

[52] U.S. Cl. ..... 187/17; 52/115

[58] Field of Search ..... 187/17, 95, 1 R; 52/115; 182/141

[56] References Cited

U.S. PATENT DOCUMENTS

| | | | |
|---|---|---|---|
| 2,214,588 | 9/1940 | Lagerquist et al. | 187/17 |
| 3,613,834 | 10/1971 | Field | 187/17 |
| 3,650,356 | 3/1972 | Brown | 187/17 |
| 3,741,351 | 6/1973 | Suozzo | 187/95 |
| 3,954,157 | 5/1976 | Atkey | 187/17 |

*Primary Examiner*—Stanley H. Tollberg
*Assistant Examiner*—Kenneth Noland
*Attorney, Agent, or Firm*—D. R. Lackey

[57] ABSTRACT

A hydraulic elevator system which utilizes a single hydraulic jack having a cylinder fixed below an elevator car, and a plunger. The elevator car is supported on the end of the plunger. The hydraulic jack extends upwardly and into the elevator car, reducing the space required below the car by the amount of the penetration of the hydraulic jack. The hydraulic jack is disposed adjacent to the front portion of the hatchway, enabling it to occupy an enclosed, concealed space in the elevator car, between its entranceway and its operational controls.

8 Claims, 2 Drawing Figures

10

ELEVATOR SYSTEM

BACKGROUND OF THE INVENTION

1. Field of the Invention

The invention relates in general to elevator systems, and more specifically to hydraulic elevator systems in which the hole required for the hydraulic jack is eliminated, or substantially reduced in depth.

2. Description of the Prior Art

Hydraulic elevator systems conventionally require a hole in the ground for the hydraulic jack which is as deep as the vertical travel dimension of the elevator car. The cost of drilling the hole is substantial. When the hydraulic elevator is to be installed in a low rise building having only a few floors, for use primarily by the handicapped, the cost of drilling the hole may be a relatively large portion of the elevator system cost, because a relatively low cost elevator construction is used for such low rise applications.

Prior art attempts to eliminate the hole have used two hydraulic jacks, disposed on opposite sides of the elevator car. Another prior art arrangement has made the cylinder portion of the hydraulic jack a part of the car structure, adding the weight of the cylinder and hydraulic oil to the weight which must be lifted by the power unit.

SUMMARY OF THE INVENTION

Briefly, the present invention is a new and improved hydraulic elevator system which utilizes a single hydraulic jack arranged in the conventional orientation, wherein the hydraulic cylinder is disposed below the elevator car and is attached to the building. The hydraulic jack extends upwardly and into the elevator car, reducing the space required below the car by the amount of its penetration into the car. In a preferred embodiment, the hydraulic jack extends completely through the car, via a tunnel structure which may extend to, or above the top beam of the car frame, as required by the rise of the specific application. The end of the plunger contacts the upper end of the tunnel structure. In this preferred embodiment, the tunnel structure is constructed to provide the major vertical support function of the car frame, and it is concealed in a space located adjacent to the car front, between the entranceway to the cab and the car mounted operational controls. The car mounted operational controls are mounted on, and behind, a swing return panel member which functions as the front inner wall of the cab. An access panel or door is provided in the side vertical stile member which is on the side of the car adjacent to the vertically spaced string of hatch switches. Thus, easy access is provided to all car mounted operational controls, as well as to the hatch switches, facilitating maintenance by authorized personnel.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
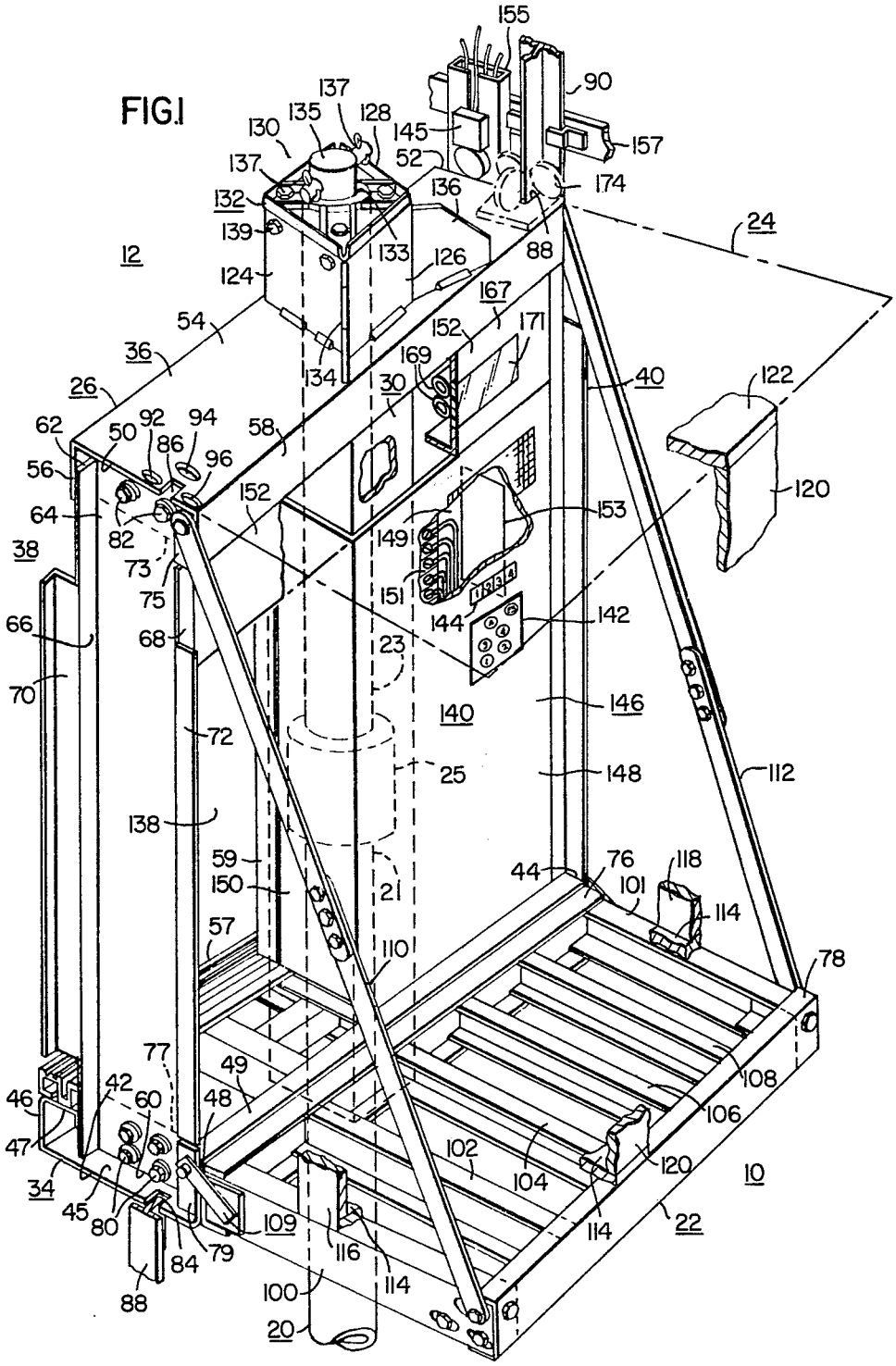
FIG. 1 is a perspective view of an elevator system having an elevator car constructed according to the teachings of the invention.

Certain features shown in the drawings but not claimed are claimed in concurrently filed application Ser. No. 219,206, entitled "Modular Elevator Car".

Figure 2:
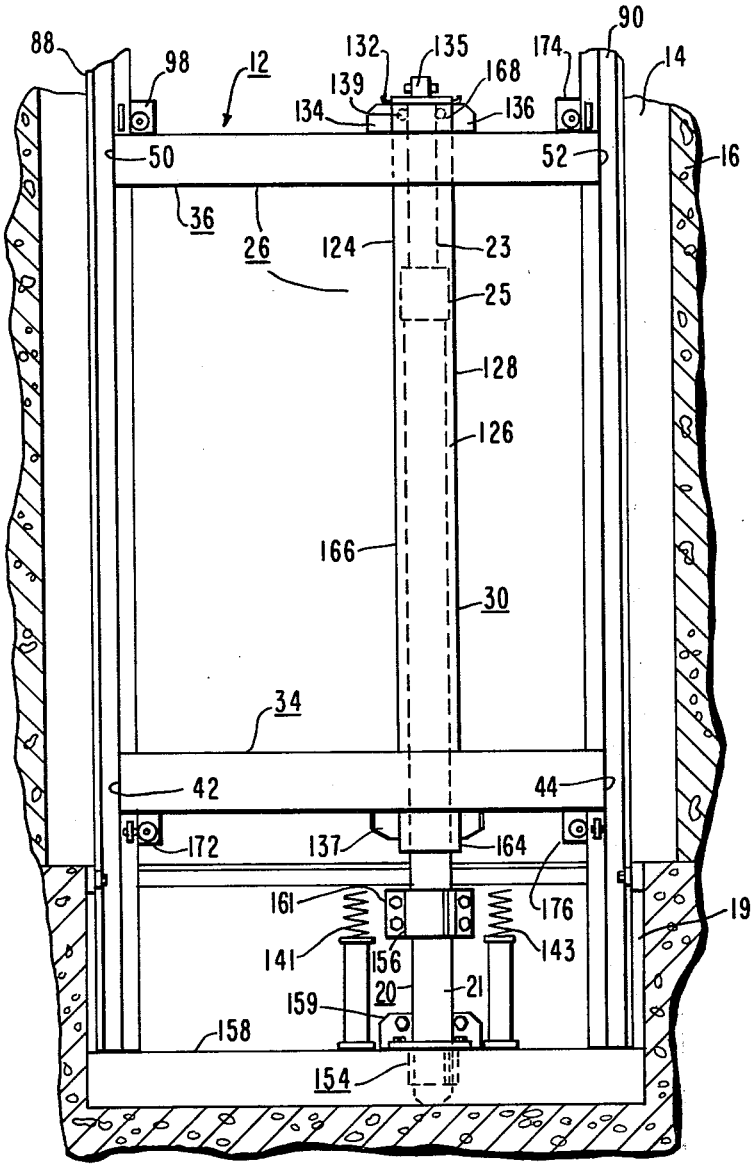
FIG. 2 is a rear elevational view of the elevator system shown in FIG. 1, with parts cut away or not shown in order to more clearly set forth the teachings of the invention.

Referring now to the drawings, FIG. 1 is a perspective view of an elevator system 10 constructed according to the teachings of the invention and FIG. 2 is a rear elevational view. Elevator system 10 includes an elevator car 12 mounted in a hatchway 14 of a building 16 to serve the floors therein. A single hydraulic jack 20 mounted in the hatch pit 19 at the bottom of hatchway 14 provides the motive means for elevator car 12. Hydraulic jack 20 may be conventional, having a cylinder 21, a cylinder head 25, and a single plunger 23, or it may be a telescopic jack.

Elevator car 12 includes a platform 22, a cab 24 mouned on platform 22, and structural support means 26 for supporting the platform and cab according to the teachings of the invention. The structural support means 26 includes a metallic elongated tunnel-like structure 30 for receiving the hydraulic jack, eliminating or reducing the depth of a hole in the ground for the hydraulic jack, as will be hereinafter explained. In a preferred embodiment of the invention, the tunnel structure 30 is disposed at the extreme front of the elevator car 12, and it also extends to, or above, the top of cab 24, and the invention will be described in this context.

More specifically, the structural support means 26 of elevator car 12 is an upstanding sling or car frame formed of structural steel. Car frame 26 includes horizontally oriented, vertically spaced bottom and top portions, such as provided by bottom and top beam members 34 and 36, respectively. In a preferred embodiment of the invention the major vertical structural member of the car frame 26 is provided by the tunnel 30, which extends through openings in the bottom and top beam members 34 and 36, and is welded thereto. First and second side portions, such as provided by upstanding stile members 38 and 40, may be formed of relatively thin sheet metal in the preferred embodiment, since tunnel 30 is constructed to provide the major vertical support function. However, it is to be understood that stile members 38 and 40 may be constructed to provide the major vertical support function, if desired. Bottom beam member 34 has first and second ends 42 and 44, respectively, and a predetermined cross-sectional configuration, such as the substantially U-shaped cross-sectional configuration illustrated. The U-shaped configuration includes bight portion 45 and first and second upstanding leg portions 46 and 48, respectively. The upstanding leg portions 46 and 48 have their ends bent towards one another in a common plane to provide integral horizontally oriented flanges 47 and 49. The bottom beam member 34 is dimensioned such that the spacing between the aligned ends of flanges 47 and 49 is sufficient to receive tunnel 30.

The top beam member 36 has first and second ends 50 and 52, respectively, and a predetermined cross-sectional configuration, such as the substantially U-shaped cross-sectional configuration illustrated, which includes a bight portion 54 and first and second depending leg portions 56 and 58, respectively.

The upstanding stile members 38 and 40 each have first and second ends, such as first and second ends 60 and 62, respectively, of stile member 38. The stile members, such as stile member 38, have predetermined cross-sectional configurations, such as a substantially U-shaped cross-sectional configuration including a bight portion 64 and first and second leg portions 66 and 68, respectively. The first and second leg portions may include integral flanges 70 and 72 at their ends, with the flanges being aligned with one another but bent in opposite directions.

Substantially Z-shaped mounting brackets are welded between the leg portions 56 and 58 of the top beam member 36, one adjacent to each end, to provide mounting points for the second ends of stile members 38 and 40, as well as solid anchor points for diagonal braces when the stile members 38 and 40 are not constructed to provide significant vertical support for the car frame. For example, a Z-shaped mounting bracket 73 is welded adjacent to end 50 of top beam member 36, with one leg 75 being visible in FIG. 1.

In like manner, mounting brackets are welded between the leg portions 46 and 48 of the bottom beam member 34, one adjacent to each end, to provide mounting points for the first ends of stile members 38 and 40, as well as anchor points for mounting platform 22. For example, a Z-shaped mounting bracket 77 is welded adjacent to end 42, with one leg 79 thereof being visible in FIG. 1.

Suitable nut and bolt combinations 80 may be used to connect the first ends of the stile members 38 and 40 to the lower beam member 34, and nut and bolt combinations 82 may be used to connect the second ends of the stile members 38 and 40 to the top beam member 36.

The bottom and top beam members 34 and 36 have slots cut in their bight portions, at their extreme ends, such as slot 84 in end 42 of bottom beam member 34, and slots 86 and 88 in ends 50 and 52, respectively, of top beam member 36, for receiving the nose portion of a guide rail, such as guide rails 88 and 90. The bight portions of the bottom and top beam members 34 and 36 additionally include a plurality of elongated openings adjacent to the guide rail slots for mounting guide roller assemblies, such as openings 92, 94 and 96 adjacent to guide rail slot 86 in the top beam member 36, for receiving guide roller assembly 98, which is shown in FIG. 2.

Platform 22, is a rectangular structural steel framework having an outer periphery constructed of spaced parallel front and back beam members 76 and 78, respectively, and first and second side beam members 100 and 101, respectively, which interconnect the front and back beam members, such as by welding. The front and back beam members 76 and 78 may include a substantially C-shaped cross-sectional configuration, oriented and sized to receive side beam members 100 and 101, and a plurality of parallel, spaced, intermediate beam members, such as members 102, 104, 106 and 108. As described in detail and claimed in the hereinbefore mentioned co-pending application, platform 22 is pivotable between the operational configuration illustrated, and a vertically oriented shipping configuration via pivot assemblies, such as pivot assembly 109.

Diagonal side brace members 110 and 112 and fixed between the car frame 26 and platform 22, such as by bolting one end of member 110 to the upper beam structure and by welding its remaining end to the side beam member 100, and by bolting one end of member 112 to the upper beam structure, and by welding its remaining end to the side beam member 101. Brace members 110 and 112 are constructed to permit platform 22 to be pivoted between its shipping and operational positions.

Suitable flooring 114 is mounted on platform 22, and the cab 24 is mounted on the flooring 114, with the cab including side panels 116 and 118, a back panel 120, and a ceiling 122.

Flange 47 of the bottom beam member 34 supports a threshold plate 57 which divides the entranceway into the cab from the hatch door entrance into the elevator car 12. A car door 59 is mounted for slidable motion to open and close the entranceway. A door operator (not shown) suitable for operating door 59 is disclosed in concurrently filed application Ser. No. 219,102, entitled "Elevator System".

Elongated tunnel structure 30, which may have a square or a round opening therein, such as the square configuration illustrated, extends through suitable openings in the bottom and top beam members 34 and 36, respectively. When tunnel structure 30 defines a square opening, it may have four metallic side members 124, 126, 128 and 130 suitably fixed together, such as by welding. Generally, tunnel structure 30 is a structural part of the car frame or sling, and as such, it includes an end plate 132 against which the end of the plunger 23 makes contact. End plate 132 may have a small opening 133 therein for receiving a portion 135 of the top of the plunger 23, to clearly indicate that the plunger 23 is properly centered with and attached to the end plate 132. A pin 137 is disposed through a transverse opening in portion 135. In the preferred embodiment of the invention, tunnel 30 extends between and is welded to both the bottom and top beam members 34 and 36, respectively, and it provides the major vertical structural support for the car frame 26. Stile members 38 and 40, in this embodiment, may be constructed of relatively thin sheet metal, such as normally used for door strike jambs.

Since it is desirable to eliminate the normal hole for receiving the hydraulic jack 20, or to at least reduce the depth of the hole to about four feet or less, since holes less than four feet need not be drilled, the end plate 132 is preferably located above the level of the upper beam 36. As hereinbefore stated, end plate 132 is, in effect, a structural part of the car frame 26 which result may be accomplished by welding at least certain of the metallic sides 124, 126, 128 and 130 of the tunnel structure 30 to the upper beam member 36. As illustrated, additional strengthening ribs or members 134 and 136 may be welded to the tunnel structure 30 and to the top beam member 36. End plate 132 is removably fixed to the metallic side members which define the tunnel structure 30. For example, four drilled and tapped metallic blocks (not shown) may be supported from the underside of end cap 132 via bolts 137 which extend downwardly through holes provided in end plate 132. These four blocks each have two additional drilled and tapped holes whose axes are perpendicular to the axis of the holes which cooperate with bolts 137, and whose axes are perpendicular to one another. Holes are provided through the side walls of tunnel 30 for receiving bolts 139 which engage the additional tapped holes in the metallic blocks. Car 12 may thus be lowered to its buffers 141 and 143 and end plate 132 removed to service the cylinder head, or heads.

As hereinbefore set forth, instead of terminating the tunnel structure 30 at the upper beam member 36, the tunnel structure 30 preferably extends downwardly, completely through the elevator car 12, such that it extends through and below the bottom beam member 34. As shown in FIG. 2, tunnel 30 is preferably welded to the lower beam member 34, with a plurality of strengthening ribs 137, shown in FIG. 2, being welded to the bottom beam member 34 and to the tunnel structure 30. This arrangement of the tunnel causes the tunnel to completely surround and protect the hydraulic jack 20, as well as providing segregation and isolation between the hydraulic jack 20 and the inside of the elevator car 12. The tunnel 30, when constructed to provide a strong steel tubular assembly which is welded to the lower and upper beam members of the car frame, can provide the major or primary vertical structural requirement of the car frame 26.

Locating the tunnel 30 at the extreme front of the elevator car 12 enables it to be concealed from the view of passengers in the elevator car 12. It may be conveniently located between an opening 138 which defines the entranceway into cab 24, and the car mounted operational controls 140, such as the car call pushbutton station 142 and the car position indicator 144. An L-shaped swing return panel 146 having first and second legs 148 and 150, respectively, may have the first leg 148 disposed to form a portion of the internal cab front, upon which certain of the operational controls 140 are mounted, and the second leg 150 disposed to provide a side wall of the entranceway. A transom 152 is disposed above the swing return panel 146, and above opening 138, also adding to the concealment of the tunnel structure 30. The transom 152 may be modified to include lighting means 167, such as fluorescent lamps 169 disposed behind a translucent panel 171. Instead of, or in addition to transom lighting, the car top 122 may include built-in lighting fixtures for providing cab lighting, as desired.

An important aspect of the invention is the ready access to all car mounted operational controls, and to the hatch switches, from within the elevator car. Thus, authorized maintenance personnel may service the elevator car 12 without the necessity of gaining access to the top of the elevator car. In addition to the car station 142 and car position indicator 144, which are mounted on the back side of the swing return, additional items such as an emergency lighting source and a telephone door and telephone, may be mounted on the swing return. The swing return 146 may also include a grill adjacent to a ventilating fan which may be mounted on the swing return, or on a panel 149 behind the swing return. Terminal boards 151, and other controls may be mounted on panel 149. Stile 40 may have an access panel 153 disposed to cover an opening in the stile which is aligned with the hatch mounted switches. The hatch switches, such as switch 145, may be mounted on wiring conduit 155, which may be mounted on vertically spaced arm members 157, which in turn are fastened to guide rail 90.

FIG. 2 is a rear elevational view of elevator system 10 shown in FIG. 1, except that the elevator car 12 is shown without the cab 24, without stiles 38 and 40, without the car mounted operational controls 140, and without the swing return panel 146, in order to more clearly illustrate car frame 26 and certain other aspects of the invention. The cylinder portion 21 of hydraulic jack 20 may be secured in the hatch pit 19 via first and second clamping assemblies 154 and 156. Clamping assembly 154 is secured to a structural steel rectangular frame 158 mounted on the floor of the hatch pit 19, which is secured to the forward wall of pit 19 via mounting plate 159. The second clamping assembly 156, disposed above clamping assembly 154, includes an arm (not shown) which extends to a mounting plate 161 which is also fixed to the forward wall of pit 19.

Tunnel structure 30, in a preferred embodiment, includes a lower portion 164 disposed below the bottom beam member of the car frame 12, and thus below platform 22, an intermediate portion 166 disposed between the lower and upper beam members of the car frame or sling 12, and an upper portion 168 disposed above the upper beam member 36.

In addition to guide roller assembly 98, elevator car 12 additionally includes guide roller assemblies 172, 174 and 176, with guide roller assemblies 98 and 172 co-acting with guide rail 88, and with guide roller assemblies 174 and 176 co-acting with guide rail 90, to guide elevator car 12 smoothly and accurately in its vertical travel path as it is lifted and lowered via contact between the upper end of plunger 23 and the end plate 132. The guide rollers of each assembly which support the "tipping" forces, have a larger O.D. than the other rollers of each assembly.

It will be noted that the motive means for elevator car 12 is a single hydraulic jack 20 disposed completely within the vertical projection of the elevator car 12. It will further be noted that cylinder 21 is merely disposed on the bottom of hatch pit 19, without the necessity of being disposed in a costly drilled hole, and yet the elevator car 12 may be vertically operated between a plurality of floor levels. A short hole of about four feet maximum length may be provided by the same equipment used to dig pit 19, and thus need not be drilled. Thus, while cylinder 21 will usually not extend below the floor of pit 19, it is within the scope of the invention to utilize a short hole on some rises. The number of floor levels is determined by the height of the upper portion 168 of the tunnel 30, the distance between the floors, and whether or not the hydraulic jack has a single plunger, or is a telescopic jack. Instead of loading the elements of the car frame in compression, as in the prior art, the elements of the car frame are loaded essentially in tension.

In summary, the hydraulic elevator system of the invention is a relatively low cost system suitable for low rise buildings, which may be installed within new buildings, or mounted on the outside wall of existing buildings, without the necessity of drilling a hole for the hydraulic jack. In a preferred embodiment, the tunnel structure, which eliminates the need for a drilled hole, is strengthened to the point which enables it to function as the primary vertical structural member of the car frame, enabling the side stile members to function as secondary support members. Thus, the stile members may be formed of relatively thin sheet metal. Further, the hydraulic elevator system of the invention is easy to service, as all car mounted operational controls, as well as the hatch mounted switches, are all accessible from within the car by unlocking and opening a swing return panel which forms the inner front wall of the cab.

We claim as our invention:

1. An elevator system, comprising:

a building having vertically spaced floors and a hatchway, an elevator car in said hatchway, said elevator car including a platform, a cab on said platform having an entranceway and side wall and top portions, and structural support means for said cab platform, said support means including a car frame having a lower beam member below the platform, an upper beam member above the cab, and a hollow elongated member which extends between and is fixed to at least one of said lower and upper beam members, said elongated member having upper and lower ends, with its upper end being at least partially closed, and a single hydraulic jack at the bottom of said hatchway, within the vertical projection of said elevator car, said hydraulic jack including a cylinder and at least one plunger, with said cylinder being secured to said building, and with said at least one plunger having an end portion which supports said elevator car in said hatchway, said hydraulic jack entering the lower end of said elongated member, with the end of its at least one plunger in contact with the at least partially closed end of said elongated member, said hydraulic jack being operable to lift and lower said elevator car in a vertical travel path to serve the floors of said building, at least a portion of said hydraulic jack extending upwardly into said elevator car as said elevator car travels between the limits of its vertical travel path, reducing the space required below said elevator car to accommodate said hydraulic jack.

2. The elevator system of claim 1 wherein the top and bottom beam members have openings therein through which the elongated member extends, with the upper end of the elongated member extending above the top beam member, and with the lower end of the elongated member extending below the bottom beam member.

3. The elevator system of claim 2 wherein the elongated member is fixed to both the top and bottom beam members, and is constructed to provide the primary vertical support function of the car frame.

4. An elevator system, comprising:

a building having vertically spaced floors and a hatchway, an elevator car in said hatchway, said elevator car including a platform, a cab on said platform having an entranceway and side wall and top portions, and structural support means for said cab and platform, said elevator car including a front portion with which the entranceway to the cab is associated, with the support means including a car frame disposed at said front portion, said car frame including top and bottom beam members having vertically aligned openings therein, a hollow tunnel structure disposed through the openings in the top and bottom beam members, and fixed to both of them, said tunnel structure having upper and lower ends, with its upper end being at least partially closed, and a single hydraulic jack at the bottom of said hatchway, within the vertical projection of said elevator car, said hydraulic jack including a cylinder and at least one plunger, with said cylinder being secured to said building, said hydraulic jack entering the lower end of said tunnel structure, with the end of the at least one plunger in contact with the at least partially closed upper end of said tunnel structure to support said elevator car in said hatchway, said hydraulic jack being operable to lift and lower said elevator car in a vertical travel path to serve the floors of said building, at least a portion of said hydraulic jack extending upwardly into said elevator car as said elevator car travels between the limits of its vertical travel path, reducing the space required below said elevator car to accommodate said hydraulic jack.

5. The elevator system of claim 4 including operational controls disposed on the platform, at the front of the elevator car, with the tunnel structure being disposed between the entranceway and said operational controls.

6. The elevator system of claim 5 including a swing return panel member which covers both the operational controls and the tunnel structure.

7. The elevator system of claim 6 including an additional panel member disposed behind the swing return panel member, with certain of the operational controls being mounted on the swing return panel member and certain of the operational controls being mounted on the additional panel member.

8. The elevator system of claim 7 including hatch switches in the hatchway, and further including a vertically extending stile member accessible when the swing return panel member is open, with said stile member having an opening therein aligned with said hatch switches, enabling access to be gained to said hatch switches from within the elevator car.

* * * * *